US005213558A

United States Patent [19]

Miller et al.

[11] Patent Number: 5,213,558

[45] Date of Patent: May 25, 1993

[54] EXERCISE DEVICE

[75] Inventors: Randy Miller, 1322 Crowley Ave., Madison, Wis. 53704; David W. Wendt, Madison, Wis.

[73] Assignee: Randy Miller, Madison, Wis.

[21] Appl. No.: 911,526

[22] Filed: Jul. 10, 1992

[51] Int. Cl.[5] ..... A63B 21/00

[52] U.S. Cl. ..... 482/140; 482/904

[58] Field of Search ..... 482/140, 904; 5/417, 5/420

[56] References Cited

U.S. PATENT DOCUMENTS

| | | | |
|---|---|---|---|
| D. 203,836 | 2/1966 | Hass . | |
| 1,939,165 | 8/1934 | Turner . | |
| 2,050,652 | 8/1936 | Fleming . | |
| 3,222,695 | 12/1965 | Brown | 5/417 |
| 4,121,825 | 10/1978 | Hult . | |
| 4,417,726 | 11/1983 | Schleis . | |
| 4,593,902 | 6/1986 | Michaelson . | |
| 4,602,782 | 7/1986 | Carlson . | |
| 4,611,805 | 9/1986 | Franklin et al. . | |
| 4,705,270 | 11/1987 | Melton . | |
| 4,714,247 | 12/1987 | Gerstung | 482/23 |
| 4,909,505 | 3/1990 | Tee . | |

FOREIGN PATENT DOCUMENTS

| | | | |
|---|---|---|---|
| 1073169 | 1/1960 | Fed. Rep. of Germany | 5/420 |

OTHER PUBLICATIONS

"Lifeline" Waistliner Sit-Up Bar Brochure, published by Lifeline Production and Marketing, Inc., Madison, Wisconsin, at least as early as 1991.

"Don't Just Workout" catalog by Excel, Pico Rivera, CA, pp. 41 and 42, published at least as early as 1991.

"Shape Rx Shop" catalog by Dynamic Classics, Ltd, Saddlebrook, NJ, published in 1990.

"TUNTURI Accessories II" flyer, by Tunturi Inc., Redmond, WA, published at least as early as 1991.

*Primary Examiner*—Richard J. Apley

*Assistant Examiner*—Donna L. Maraglio

*Attorney, Agent, or Firm*—Andrus, Sceales, Starke & Sawall

[57] ABSTRACT

The integral exercise device is made from a flexible plastic material and is designed to be rolled up into a compact unit when not in use. The exercise device includes a main body portion having apertures for receiving the user's feet or other body part, a connector portion that slides underneath a stationary object such as a door, and a shoulder portion that abuts one side of the door during use. The shoulder portion opposes the forces imposed by the user during exercising to maintain the user's feet in the desired position. The main body portion of the exerciser may be positioned by the user to any desired height. A fastener retains the exerciser in its rolled-up condition for easy transportation and storage.

13 Claims, 2 Drawing Sheets

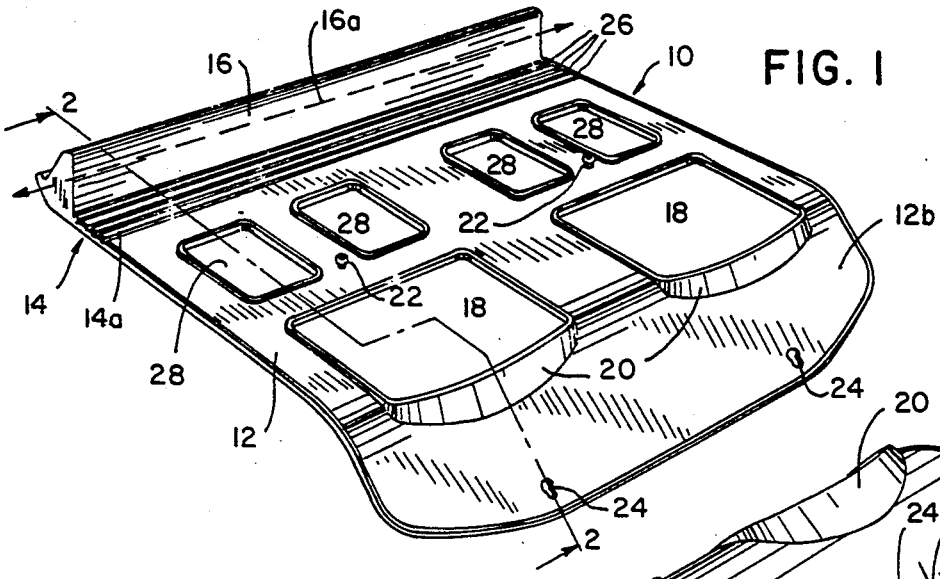
FIG. 1
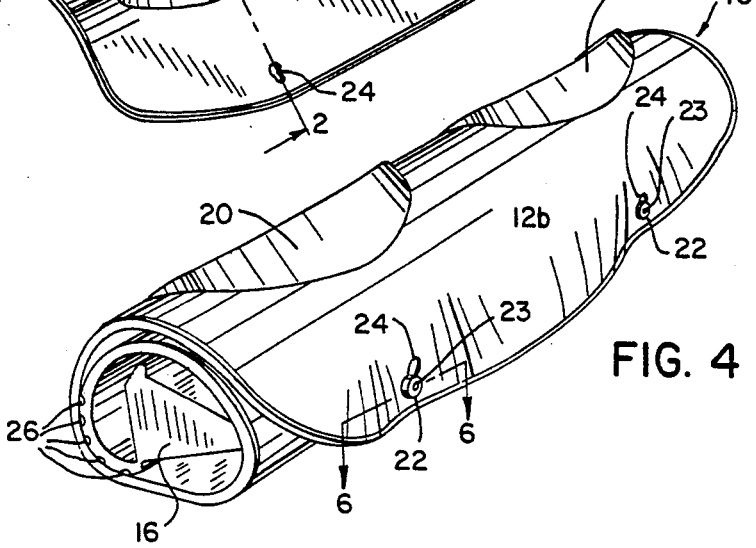
FIG. 4
FIG. 7
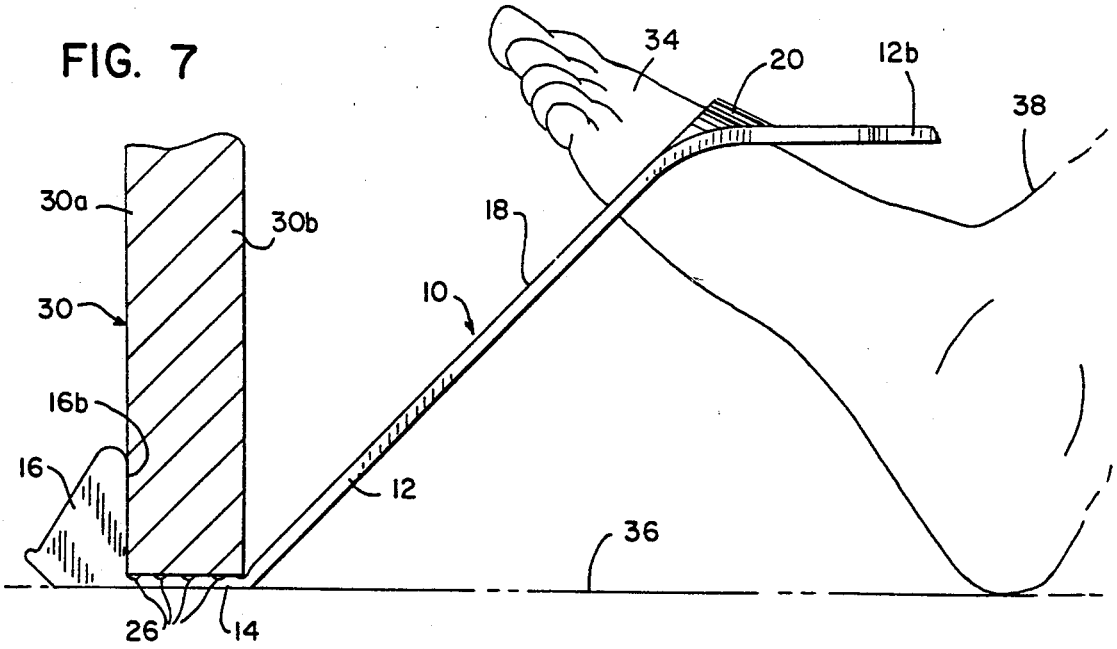

EXERCISE DEVICE

BACKGROUND OF THE INVENTION

This invention relates to exercise equipment and devices. More particularly, this invention relates to portable sit-up exercise devices.

Many types of exercise devices are known for exercising different muscles groups of the human body. Most exercise devices are large and heavy, preventing them from being readily moved from one room to another, or from being easily stored. Such exercise devices are typically complicated and expensive as well.

It is also difficult for fitness enthusiasts who travel for work or pleasure to have ready access to fitness equipment when they are staying away from home. Although several types of portable fitness equipment are known, these devices are typically not sufficiently small or lightweight to be readily carried from one place to another. Also, most portable devices have a number of component parts which have the disadvantage of either requiring assembly or wearing out.

Therefore, it is desirable to provide a portable, lightweight exercise device which is compact and which may be easily carried from one place to another.

SUMMARY OF THE INVENTION

A sit-up exercise device is disclosed for use with a stationary object such as a closed door or piece of furniture. The exercise device preferably consists of a single, integral plastic piece that is readily rolled up, carried from one place to another, or stored.

The sit-up exerciser preferably includes a flexible body portion that is adapted to being rolled into a rolled-up condition and then fastened in that condition by a fastener means.

When the exerciser is being used, the body portion is positioned so that it substantially lies on a first side of a door or other stationary object. The body portion includes one or two apertures therein that are adapted to receive human feet. Since the body portion is flexible, the body portion and its apertures are universal in that they may be positioned to different positions or heights as desired by the user.

A shoulder means is interconnected with the body portion via a connector means and abuts the opposite, second side of the stationary object. The shoulder means may also be integrally formed with the connector means and the body portion. In a preferred embodiment, the shoulder means includes an elongated member having a substantially flat side for abutting the opposite side of the stationary object. The exerciser is very stable during use due to the large surface area of contact between the flat side and the stationary object. The elongated member preferably has a substantially triangular cross-section in a plane that is normal to its longitudinal axis.

The connector means that connects the shoulder means to the body portion is adapted to substantially lie underneath the stationary object. It may be formed integral with the body portion or may be attached to the body portion. In a preferred embodiment, the connector means comprises a substantially flat, flexible plastic material having a plurality of substantially parallel grooves on its upper surface. These grooves facilitate the rolling up of the exercise device when it is not in use.

When the exercise device is in its rolled-up condition, it is preferably held together by a fastener means comprising at least one button extending from an upper surface of the body portion, and a slot in the body portion that is adapted to receive the button.

It is a feature and advantage of the present invention to provide an exercise device that is lightweight, portable and easily carried from one location to another.

It is another feature and advantage of the present invention to provide an exercise device that may be rolled up into a compact unit when it is not in use.

It is yet another feature and advantage of the present invention to provide an exercise device that consists of a single integral unit and that is easy to manufacture.

It is yet another feature and advantage of the present invention to provide a universal sit-up exerciser that is positionable to substantially any position desired by the user without any mechanical adjustments.

It is yet another feature and advantage of the present invention to provide a lightweight, thin walled yet strong and durable exercise device.

It is yet another feature and advantage of the present invention to provide a sit-up exerciser that is very stable during use.

It is yet another feature and advantage of the present invention to provide a washable exercise device with non-marring surfaces.

These and other features and advantages of the present invention will be apparent to those skilled in the art from the following detailed description of the preferred embodiment and the drawings, in which:

BRIEF DESCRIPTION OF THE DRAWINGS

FIG. 1 is a perspective view of the exercise device according to the present invention.

FIG. 4 is a perspective view depicting the exercise device in the rolled-up condition.

FIG. 7 is a side view depicting the exercise device in use.

DETAILED DESCRIPTION OF THE PREFERRED EMBODIMENT

Figure 2:
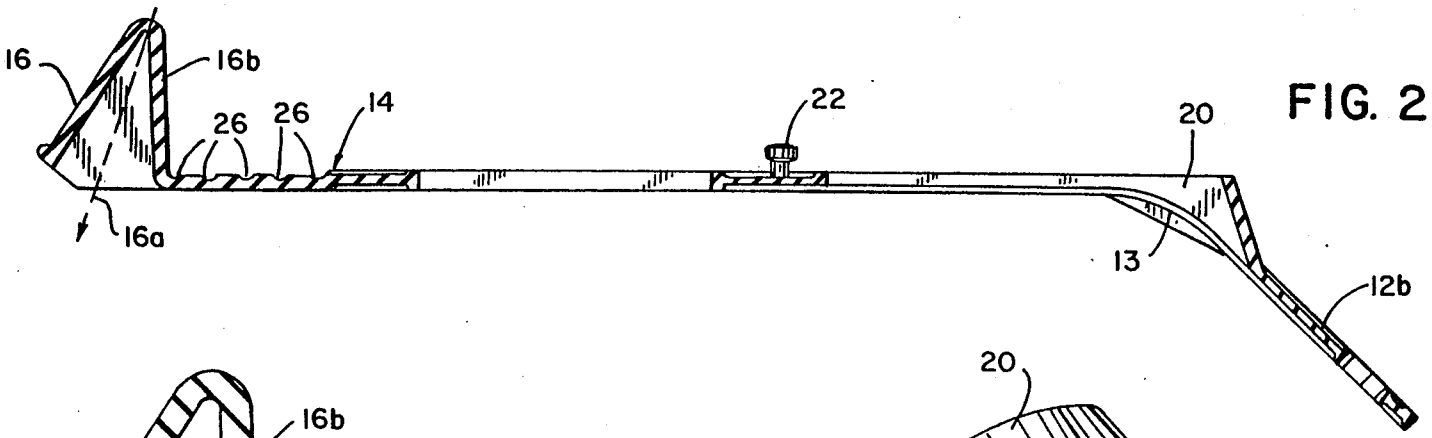
FIG. 2 is a cross-sectional side view of the exercise device, taken along line 2—2 of FIG. 1.

FIG. 1 is a perspective view of the sit-up exerciser according to the present invention. In FIG. 1, exerciser 10 includes a main body portion 12, a connector portion 14, a shoulder means 16, a pair of apertures 18 within body portion 12, foot support members 20 which support and restrain the user's feet when the exerciser is in use (FIG. 7), and a fastener means consisting of buttons 22 extending from upper surface **12*a* of body portion 12, and a pair of slots 24 in angled section 12*b* of body portion 12**.

Connector portion 14 includes a plurality of spaced, substantially parallel grooves 26 in its upper surface **14*a* to facilitate the rolling up of exerciser 10. Apertures 28 in body portion 12 are intended to reduce the amount of material required to form body portion 12**.

In a preferred embodiment, body portion 12, connector 14 and shoulder means 16 are formed as an integral unit from a flexible, plastics material which is tension resistant, lightweight and washable. One suitable material is a flexible polyvinyl chloride, although a thermoplastic rubber may also be used.

The cross-sectional side view of exerciser 10 depicted in FIG. 2 more clearly shows the profile of exerciser 10 As shown in FIG. 2, body portion 12 is substantially flat except for angled portion 12*b* which, along with supports 20, provide additional strength for exerciser 10. Angled portion 12*b* also increases the compactness of exerciser 10 when the exerciser is in its rolled-up condition. A plurality of ribs 13 help retain angled portion 12*b* in its angled position.

As also shown in FIG. 2, shoulder means 16 has a substantially triangular cross-section in the plane depicted in FIG. 2 which is normal to longitudinal axis 16*a* of shoulder means 16. It has been found that this configuration provides a great deal of strength for shoulder means 16 while minimizes the amount of material that must be used to form shoulder means 16. Shoulder means 16 also has an angled section 16*c* which lessens the likelihood that the shoulder means will fold into itself when it is placed under stationary object 30 (FIG. 7).

As shown in FIG. 2, shoulder means 16 has a substantially flat side 16*b* which abuts one side of a stationary object such as a door 30 (FIG. 7). Other types of stationary objects may be used, such as a piece of furniture.

Connector means 14, which connects shoulder means 16 to body portion 12 is preferably substantially flat and is preferably formed integral with body portion 12 and with shoulder means 16. In the alternative, shoulder means 16 may be formed from a distinct part from connector means 14, and may be mechanically fastened to connector means 14. Similarly, connector means 14 may be formed from body portion 12 and then mechanically attached to body portion 12.

Figure 3:
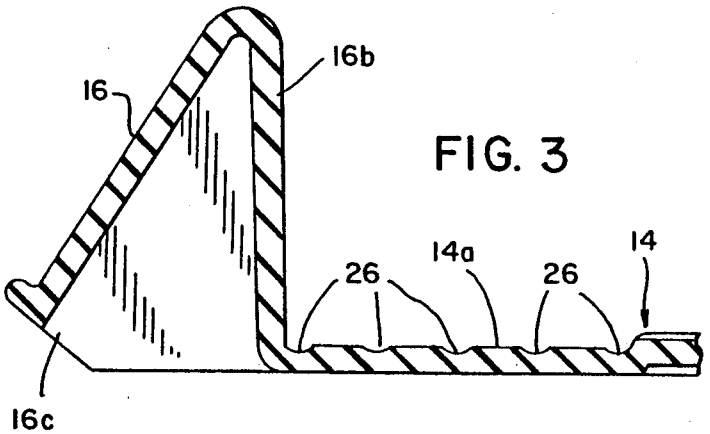
FIG. 3 is a side cross-sectional view of the shoulder means and the connector means according to the present invention.

Connector means 14 preferably includes a plurality of substantially parallel, elongated grooves 26 on its upper surface 14*a*. The purpose of grooves 26 is to facilitate the rolling up of connector means 14 when exerciser 10 is rolled to its rolled-up condition. FIG. 3 is an exploded view which more clearly depicts connector means 14, grooves 26, and shoulder means 16.

Figure 5:
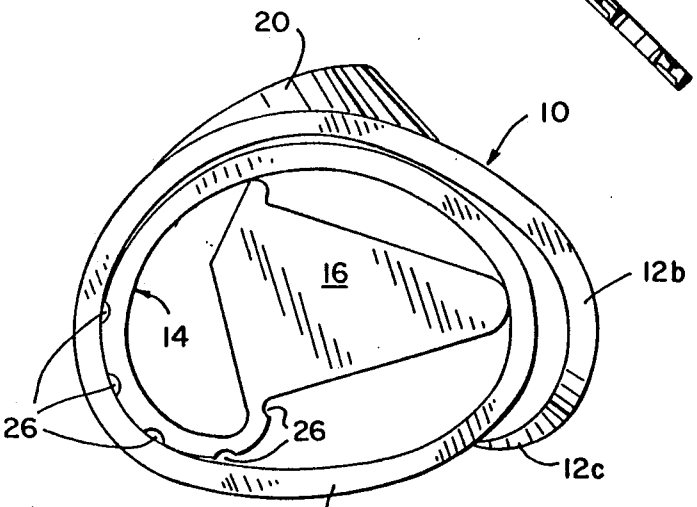
FIG. 5 is an end view of the exercise device in the rolled-up condition.

FIGS. 4 and 5 depict exerciser 10 in its rolled up condition. In its rolled-up condition, exerciser 10 is very compact, is easily stored, and is readily transported from one place to another under one's arm, in a briefcase, or in a piece of luggage.

As shown in FIGS. 4 and 5, grooves 26 allow connector means 14 to be more easily bent into a tight roll by reducing the stress on the material. Shoulder means 16 is disposed at the center of rolled-up exerciser 10, with connector portion 14 and body portion 12 being rolled around shoulder means 16. Angle portion 12*b* and its tapered end 12*c* facilitate the rolling up of exerciser 10 into a tight, compact unit.

Figure 6:
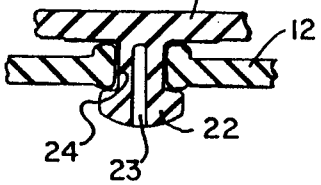
FIG. 6 is a cross-sectional end view of the fastener means, taken along line 6—6 of FIG. 4.

The fastener means, consisting of buttons 22 and slots 24, retain exerciser 10 in the rolled-up condition. Buttons 22 are either slid or pressed into slots 24. FIG. 6 is a cross-sectional view that more clearly depicts a button 22 and the manner in which it is retained in a slot 24. Button 22 has a slot 23 therein which allows button 22 to be more readily compressed when the button is pressed into slot 24. Other fastener means may be used in place of buttons 22 and slots 24, such as snaps or VELCRO brand hook and loop fasteners.

The use of the exercise device according to the present invention will be described in connection with FIG. 7. As shown in FIG. 7, connector means 14 is slid underneath a stationary object 30 such as a door or a piece of furniture. If the stationary object is a door, the door is then closed. Exerciser 10 is positioned so that flat surface 16*b* of shoulder means 16 abuts one side 30*a* of stationary object 30. Exerciser 10 is also positioned so that substantially all of body portion 12 is disposed on an opposite side 30*b* of stationary object 30.

The user then places one of his feet 34 into aperture 18. Although the preferred embodiment described herein includes two apertures 18, one for each foot, it is understood that a single aperture 18 may be used to receive both feet.

Body portion 12 maybe raised or lowered with respect to floor 36 as desired by the user. The position in which the user will place body portion 12 is in part determined by the angle between foot 34 and leg 38.

Once the user positions body portion 12 in the desired position, the user will adjust his body (not shown) lengthwise either toward or away from exerciser 10 and stationary object 30 until he is in a comfortable position. The user will typically bend his knees to position himself to do half-lift sit-up exercises. The sit-up exercises are performed by alternately raising and lowering the user's upper body.

During the exercises, exerciser 10 acts as a restraining device to retain the user's feet 34 in their proper positions. Any tension force placed on supports 20 during exercising is transferred through main body portion 12, through connector portion 14, and to shoulder means 16. Surface 16*b* abuts side 30*a* of stationary object 30 to resist these tension forces and thereby maintain the user's feet in the desired position.

The exercise device according to the present invention is universal in that it may be used with any size person regardless of the size and shape of his feet because body portion 12 and apertures 18 are positionable to any desired height with respect to floor 36. Apertures 18 are also designed to receive the user's feet regardless of whether his shoes are on or off. The ability of the user to position himself and his feet to any desired position increases the ease with which sit-up exercises are performed and thus increases the number of repetitions that may be performed using the exerciser according to the present invention.

Although the exercise device has been described as a sit-up exerciser, it may be used to perform other exercises as well. For example, the user may place his hands or arms in apertures 18 and then repeatedly raise his legs to exercise his back and abdominal muscles. The human body part that is disposed in apertures 18 will be restrained by the exercise device in a like manner to that described above.

While a preferred embodiment of the present invention has been shown and described, other embodiments will be apparent to those skilled in the art and are within the intended scope of the present invention. Therefore, the invention is to be limited only by the following claims.

We claim:

1. An exercise device that is used with a stationary object such as a closed door, said object having a first side and an opposite second side, said device comprising:

a flexible, thin sheet body portion that is adapted to being rolled into a rolled-up condition and that is adapted to substantially lie on said first side of said stationary object;

at least one aperture in said body portion that is adapted to receive a part of a human body;

shoulder means interconnected with said body portion for abutting said second side of said stationary object; and connector means for connecting said body portion to said shoulder means, said connector means substantially lying underneath said stationary object.

2. The exercise device of claim 1, further comprising:

fastener means for retaining said body portion in said rolled-up condition.

3. The exercise device of claim 2, wherein said fastener means includes:

at least one button extending from said body portion; and at least one slot in said body portion that is adapted to engage said at least one button when said body portion is in said rolled-up condition.

4. The exercise device of claim 1, wherein said body portion is made from a plastics material.

5. The exercise device of claim 1, wherein said at least one aperture includes two apertures, each of said apertures adapted to receive a part of a human body.

6. The exercise device of claim 1, further comprising:

at least one support member adjacent said aperture that supports said human body part when said human body part is disposed in said aperture.

7. The exercise device of claim 1, wherein said shoulder means comprises:

an elongated member having a substantially flat side that is adapted to abut said second side of said stationary object.

8. The exercise device of claim 7, wherein said elongated member has a longitudinal axis, and wherein said elongated member has a substantially triangular cross-section in a plane that is normal to said longitudinal axis.

9. The exercise device of claim 1, wherein said body portion, said shoulder means and said connector means comprise a single, integral unit.

10. The exercise device of claim 1, wherein said connector means is substantially flat.

11. The exercise device of claim 1, wherein said connector means is made from a flexible, plastics material.

12. The exercise device of claim 1, wherein said connector means includes at least one elongated groove to facilitate rolling said connector means when said body portion is rolled.

13. The exercise device of claim 12, wherein said connector means has an upper surface, and wherein said at least one groove includes:

a plurality of substantially parallel grooves in said upper surface.

* * * * *